US005275411A

United States Patent [19]

Breeding

[11] Patent Number: 5,275,411

[45] Date of Patent: Jan. 4, 1994

[54] PAI GOW POKER MACHINE

[75] Inventor: John G. Breeding, St. Louis Park, Minn.

[73] Assignee: Shuffle Master, Inc., Eden Prairie, Minn.

[21] Appl. No.: 4,557

[22] Filed: Jan. 14, 1993

[51] Int. Cl.[5] ..... A63F 1/12

[52] U.S. Cl. ..... 273/149 R

[58] Field of Search ..... 273/149

[56] References Cited

U.S. PATENT DOCUMENTS

| | | | |
|---|---|---|---|
| 1,850,114 | 3/1932 | McCaddin | 273/149 R |
| 2,185,474 | 1/1940 | Nott | 273/149 R |
| 2,588,582 | 3/1952 | Sivertson | 273/149 R |
| 2,778,644 | 1/1957 | Stephenson . | |
| 3,897,954 | 8/1975 | Erickson et al. | 273/149 R |
| 4,497,488 | 2/1985 | Plevyak et al. . | |
| 4,513,969 | 4/1985 | Samsel, Jr. . | |
| 4,515,367 | 5/1985 | Howard . | |
| 4,586,712 | 5/1986 | Lorber et al. . | |
| 4,750,743 | 6/1988 | Nicoletti | 273/149 R X |
| 4,770,421 | 9/1988 | Hoffman | 273/149 R |
| 4,807,884 | 2/1989 | Breeding . | |
| 4,832,342 | 5/1989 | Plevyak et al. | 273/149 R |
| 4,969,648 | 11/1990 | Hollinger et al. | 273/149 R |
| 5,000,453 | 3/1991 | Stevens et al. | 273/149 R |

*Primary Examiner*—Paul E. Shapiro
*Attorney, Agent, or Firm*—Dorsey & Whitney

[57] ABSTRACT

An automatic card shuffling machine including a dealing module and a display module. The machine has a microprocessor and a deck-receiving shuffling station into which a deck of cards is deposited initially. A carriage mechanism separates the deck into two deck portions, rotates the two portions to a relative angular relationship with a corner of each in close proximity, riffles the portions, and combines them into a single shuffled deck. A shuffled deck delivery system delivers the shuffled deck to the dealing module which moves a predetermined number of cards, one at a time, into a hand holding shoe. The display module displays game information to players. The machine is particularly well-suited for playing pai gow poker.

11 Claims, 4 Drawing Sheets

PAI GOW POKER MACHINE

TECHNICAL FIELD

The present invention relates to devices for shuffling playing cards used in playing games. In particular, it relates to an automatic mechanical or electromechanical machine for shuffling playing cards, wherein the machine includes a card dealing module and a display means, and wherein the machine is adaptable to facilitate playing different games.

BACKGROUND OF THE INVENTION

Wagering games based on the outcome of randomly generated or selected symbols are well known. Such games are widely played in gambling casinos and include card games wherein the symbols include the familiar, common playing cards. Card games such as Black Jack, Pai Gow poker, Caribbean Stud TM poker and others are excellent card games for use in casinos. Desirable attributes of casino card games are that they are exciting, that they can be learned and understood easily by players, and that they move or can be played rapidly to their wager-resolving outcome.

One of the above-mentioned games, pai gow poker, has all the desired attributes of casino games and is increasing rapidly in popularity. Broadly, the game involves up to seven players, each player receiving a seven card hand, one hand being dealt completely before the next. The first player to receive a hand is randomly selected, bets are placed, and the hands are distributed, set and shown. The bets are resolved based on the well known hierarchy of poker hands and against the dealer's hand. Because of the number of cards in each hand, the number of players, and the rapidity of play, pai gow poker requires frequent card shuffling, diminishing the excitement of the game and reducing the number of wagers placed in a given amount of time.

The fact that playing time is diminished by shuffling and dealing, particularly in games such as pai gow poker, but in other casino games as well, has lead to the development of electromechanical or mechanical card shuffling devices. Such devices increase the speed of shuffling and dealing, thereby increasing playing time, adding to the excitement of a game while reducing the time the dealer or house has to spend in preparing to play the game.

U.S. Pat. Nos. 4,513,969 (to Samsel, Jr.) and 4,515,367 (to Howard) disclose automatic card shufflers. The Samsel, Jr. patent discloses a card shuffler having a housing with two wells for receiving two reserve stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take it for presentation to the players. The Howard patent discloses a card mixer for randomly interleaving cards including a carriage supported ejector for ejecting a group of cards (approximately two playing decks in number) which may then be removed manually from the shuffler or dropped automatically into a chute for delivery to a typical dealing shoe. Neither of the Samsel, Jr. or Howard patents discloses a dealing module for dealing hands of a predetermined number of cards depending on the rules and procedures of the game being played, and neither discloses a display means for displaying game-related information to players.

U.S. Pat. No. 4,586,712 (to Lorber, et al.) discloses an automatic shuffling apparatus directed toward reducing the dead time generated when a casino dealer manually has to shuffle multiple decks of playing cards. The Lorber, et al. apparatus has a container, a storage device for storing shuffled playing cards, a removing device and an inserting device for intermixing the playing cards in the container, a dealing shoe and supplying means for supplying the shuffled playing cards from the storage device to the dealing shoe. The dealing shoe is typical, being designed to dispense or allow the dealer to extract and deal one card at a time. The Lorber, et al. apparatus is designed to intermix cards under the programmed control of a computer, but does not disclose or suggest how to provide a dealing module for automatically, sequentially dealing or forming hands having a predetermined number of cards or a display means for displaying game-related information to players.

Other known card shuffling devices are disclosed in U.S. Pat. Nos. 2,778,644 (to Stephenson), 4,497,488 (to Plevyak et al.) and 4,807,884 (issued to John G. Breeding, the inventor of the present invention, and commonly owned). The Breeding patent discloses a machine for automatically shuffling a deck of cards. The apparatus includes a deck receiving zone, a carriage section for separating a deck into two deck portions, a sloped mechanism positioned between adjacent corners of the deck portions, and an apparatus for snapping the cards over the sloped mechanism to interleave the cards. The Breeding patent is directed to providing a mechanized card shuffler whereby a deck may be shuffled often and yet the dealer still has adequate time to operate the game being played. Additionally, the Breeding shuffling device is directed to reducing the chance that cards become marked as they are shuffled and to keeping the cards in view constantly while they are being shuffled.

Although the devices disclosed in the preceding patents, particularly the Breeding card shuffling machine, provide significant improvements in card shuffling devices, such devices could be improved further if they could be equipped with a dealing module for receiving shuffled cards and for automatically dealing from the shuffled cards a number of hands one after the other, wherein each hand dealt by the module contains a predetermined, selected number of cards. Shuffling machines could also be improved if they could be adapted to facilitate playing a specific game selected from a group of different wagering games, and to display game-related information to the players.

Accordingly, there is a need for a shuffling machine for shuffling playing cards, wherein the machine is adapted for facilitating the playing of a selected card game by including a durable, efficient means for dealing hands of cards automatically, hand after hand, each hand containing a selected, predetermined number of the shuffled cards, and by including an automatic display means for displaying game information to players.

SUMMARY OF THE INVENTION

The problem outlined above is in large measure solved by the pai gow poker machine in accordance with the present invention.

An improved playing card shuffling machine is provided for randomly shuffling playing cards, for dealing the shuffled playing cards into hands, and for displaying game information to game players, thereby facilitating the playing of certain wagering games such as pai gow poker.

The preferred embodiment of the present invention comprises an automatic card shuffling machine similar to the apparatus disclosed in U.S. Pat. No. 4,807,884, the disclosure of which patent is incorporated herein by reference. The machine of the present invention includes a microprocessor or computerized controller, including at least two randomness generators, one related to shuffling procedures and the other related to display functions. The shuffling means of the machine includes a card-receiving shuffling station into which a deck of cards is deposited initially. A carriage mechanism provides for separating the deck into two deck portions, rotating the two portions to a relative angular relationship with a corner of each in close proximity, and combining the two deck portions into a single shuffled deck. A vertically movable mandrel member is adjacent to the proximal corners of the deck portions, as is a shuffle monitoring detector, and a shuffled deck delivery means is provided for delivering a shuffled deck to a dealing means.

The dealing means of the machine of the present invention comprises a shuffled deck receiving and dealing station, deck braking means for holding the deck in the dealing station, a hand holding shoe, and a card picker and accelerating means for moving a single card from the deck into the hand holding shoe. Sensors are provided for monitoring the passage of cards in the dealing means, for counting the single cards being removed from the deck to form a hand containing a selected number of cards, and to operatively couple the dealing means to the shuffling means, as well as to a display means.

The display means of the machine of the present invention comprises a player readable display board operatively connected to the dealing means through the controller of the machine. The display means is adapted to display game information to players, and is particularly suited for playing pai gow poker, wherein a player designating symbol, a number from one through seven, is randomly selected as part of the game.

An object of the present invention is to provide an automatic mechanical or electromechanical card shuffling device for shuffling cards, wherein the machine includes dealing means for dealing shuffled playing cards into hands and display means for displaying game information to game players, thereby facilitating and improving the casino playing of wagering games, particularly pai gow poker.

Another object of the present invention is to improve the card shuffling device disclosed in U.S. Pat. No. 4,807,884 by providing a dealing means operatively coupled to the device for automatically dealing or forming hands containing a selected number of cards and a display means operatively coupled to the device for displaying game information to players.

Important advantages of the present invention are that it makes automatic shuffling machines adaptable for playing any one of a group of casino wagering games, and facilitates the use of such machines in casinos by making the selected game more exciting.

In use, the machine of the present invention is operated to shuffle a deck of playing cards repeatedly, move the shuffled deck into the dealing module, deal hands containing a selected number of cards, and to select and display game information to players. An unshuffled deck of cards is placed in the card-receiving shuffling station. Under the control of the integral microprocessor, the machine separates the deck into two deck portions and rotates the two portions to a relative angular relationship with a corner of each in close proximity. The mandrel member is driven upwardly as the deck portions are urged toward each other slightly, raising or riffling the adjacent corners and interleaving the cards. The deck portions are aligned and pushed together to provide a single, randomly shuffled deck. The deck is delivered automatically to the dealing module upon demand and held in place while the bottom-most card, and each subsequent bottom-most card, is separated from the deck and moved to a hand holding shoe. While the machine is dealing, it is also randomly selecting and displaying game related information upon which players may make side bets. When a hane, made up of a certain number of cards depending on the game being played, has accumulated in the shoe, the machine stops dealing. When the dealer simply removes the hand from the shoe for distribution to a player, the machine automatically deals another hand into the shoe. The machine automatically moves repeatedly through this entire outlined sequence.

Other objects and advantages of the present invention will become more fully apparent and understood with reference to the following specification and to the appended drawings and claims.

DETAILED DESCRIPTION OF THE PREFERRED EMBODIMENT

Figure 2:
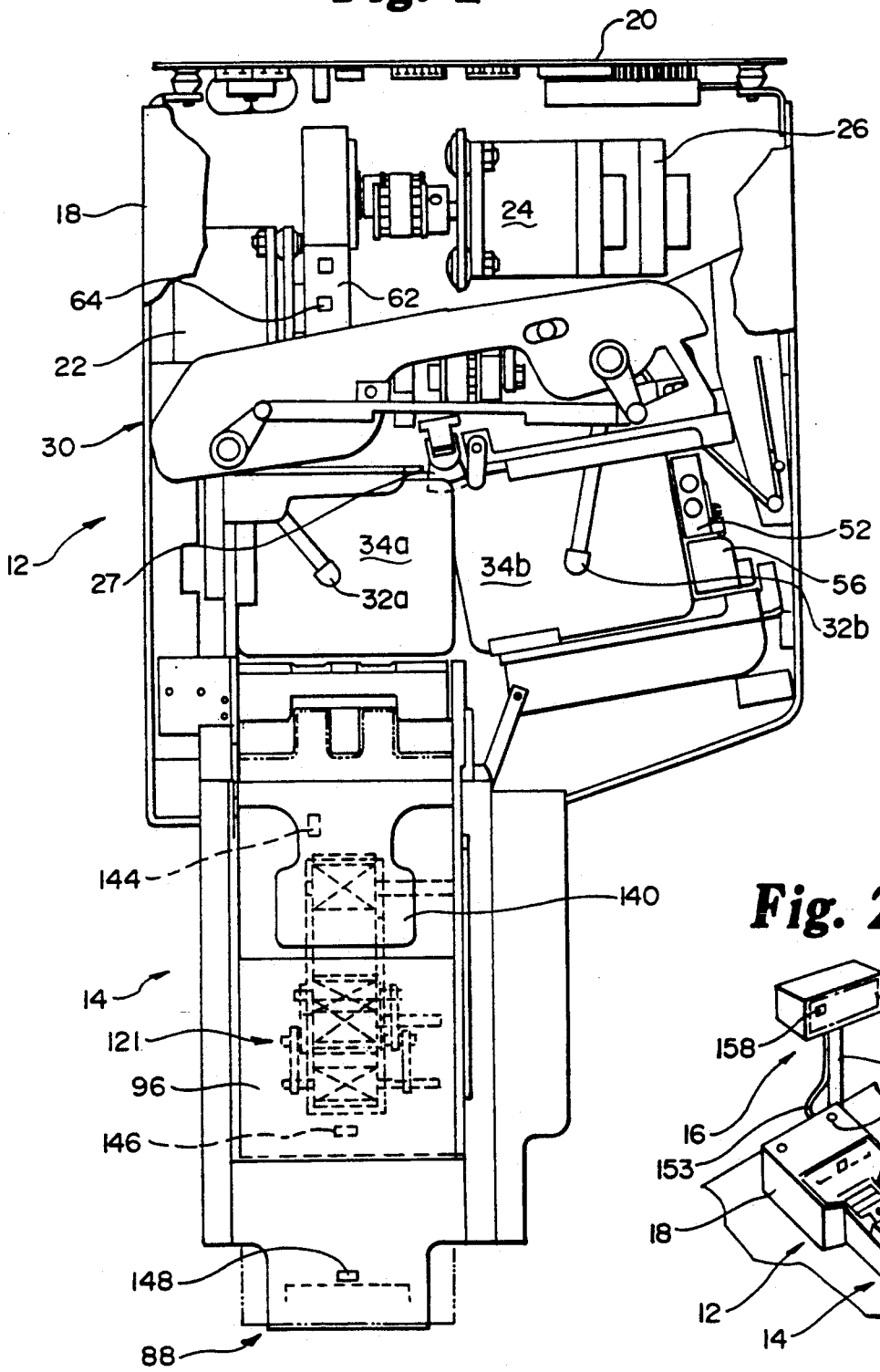
FIG. 2 is a view similar to the view of FIG. 1, depicting a deck of cards being shuffled in the machine of the present invention.
Figure 2A:
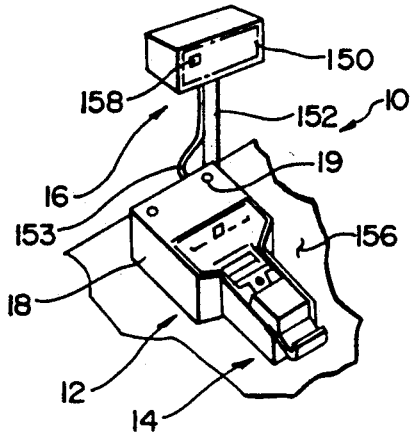
FIG. 2A is a perspective view of the present invention.

Referring to FIG. 2A, the card shuffling machine 10 of the present invention includes a card shuffling module 12, a card dealing module 14, and an information display module 16.

Figure 1:
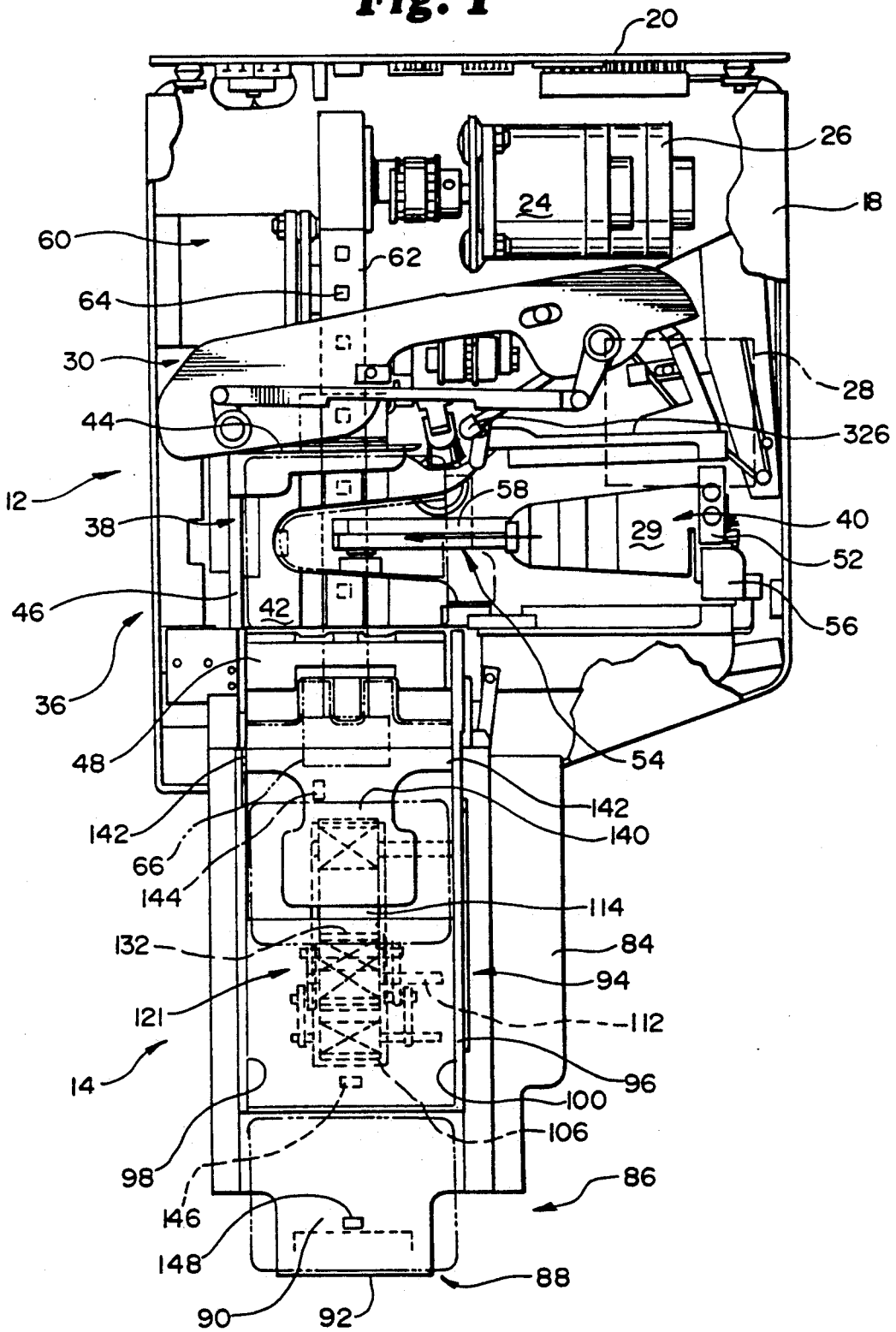
FIG. 1 is a top plan view of the shuffling machine of the present invention with portions cut away for clarity.

FIGS. 1 and 2 depict the components of the card shuffling module 12. The shuffling module 12 includes a housing 18 carrying a start switch 19 (see FIGS. 2A and 6), programmable microprocessor 20, including optoisolators 21 (see FIG. 6), motor 22 for operably powering certain deck cutting functions, motor 24 for powering the shuffled deck unloading function and motor 26 for operating the mandrel 27, which moves vertically to "riffle" and interleave the cards. Another motor 28 drives other deck cutting operations, including the generally horizontal movement of a cutting probe 29. A hold down arm assembly 30 includes hold down arms **32*a*, 32*b***, which hold down two deck portions or subdecks 34*a*, 34*b*, respectively, while they are being riffled by the mandrel 27.

The shuffling module 12 includes a shuffling and carriage area 36 having a deck receiving nest 38 and a sub-deck receiving nest 40. A generally horizontal deck supporting floor 42 is in the deck receiving nest 38 and is enclosed on three sides by a first wall 44, backstop 46 and swinging packing gate 48. The tongue-like cutting probe 29, probe mounting block 52, probe moving means 54 and a spring-loaded hold-down thumb 56 are operably mounted in the shuffling and carriage area 36. A belt and drive means 58 is provided for moving the probe 29 along its longitudinal axis toward and away from the floor 42, which is also movable, but in a generally vertical raising and lowering motion with respect to the probe 29, i.e., in a direction transverse to the generally horizontal movement of the probe 29.

Figure 5:
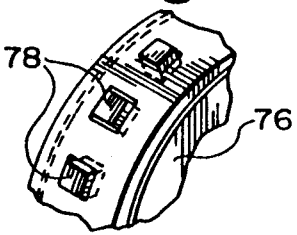
FIG. 5 is a slightly enlarged fragmentary perspective view taken from the area encircled at 5 in FIG. 3.
Figure 3:
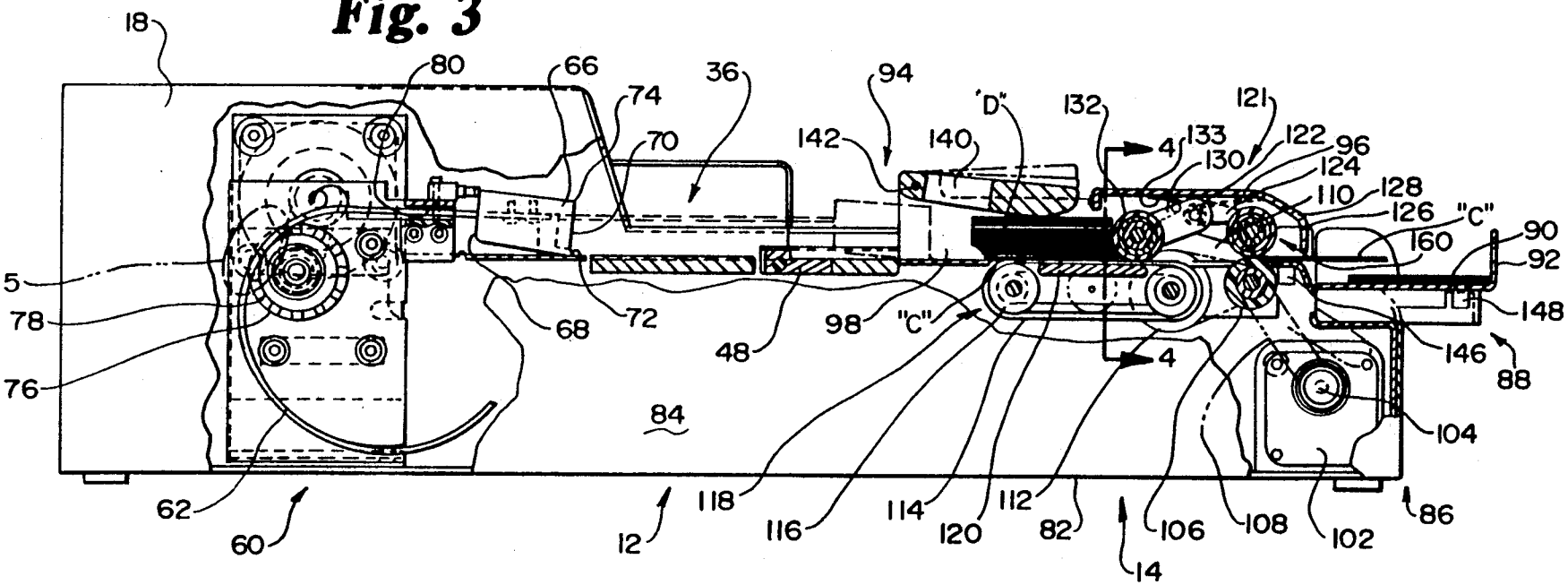
FIG. 3 is a right side elevational view of the dealing module of the shuffling machine of the present invention with parts cut away for clarity and depicting parts of the module in functional positions.

With continued reference to FIG. 1, and referring to FIGS. 3 and 5, the motor 24 is operably connected to a shuffled deck delivery system 60 for delivering a shuffled deck "D" (in FIG. 3) from the shuffling module 12 to the dealing module 14 of the present invention. The delivery system 60 includes a long, flexible transfer pusher blade 62 having a plurality of in-line apertures 64. At one end, the blade carries a transfer pusher head 66 attached at its back side 68 to the pusher blade 62. The pusher head 66 has a curved shovel face 70 with a lower edge 72 offset forwardly with respect to the upper edge 74. The delivery system 60 includes a cog wheel 76 operatively coupled to the motor 24. The cog wheel 76 carries a plurality of raised cogs 78 equally spaced about its circumference and designed to be received in the apertures 64 of the pusher blade 62. A guide block and slot arrangement 80 for guiding the pusher blade 62 is mounted behind and adjacent to the first wall 44.

Referring to FIGS. 1 and 3, the dealing module 14 is integrated with the shuffling machine 10 of the present invention. The module 14 includes a base plate 82 and a housing 84 substantially enclosing the module 14. At the free end 86 of the module, opposite the end at which it is connected with the shuffling portion 12 of the present invention, the dealing module 14 includes a hand holding shoe 88, including a generally flat, horizontal terminal stage 90 and a generally vertical terminal stop 92. Along the top of the module 14, the module includes a shuffled deck and card pathway, indicated generally at 94, extending along the longitudinal axis of the module 14 from the shuffling and carriage area 36 to the hand holding shoe 88. A portion of the pathway 94 is covered by a hood 96 detachably mounted to the housing 84 of the dealing module 14. A pair of parallel, upstanding side card guides 98, 100 are provided, one on each side of the pathway 94. A motor 102 is mounted inside the housing 84 adjacent the free end 86 of the module 14. The motor may be selected from appropriate motors such as regular AC gear or gearhead motors, including those manufactured by the Oriental Motor Co., of Tokyo, Japan. The motor output 104 is operably connected in a typical fashion to a dealing discharge drive roller 106 by a continuous belt 108. A second belt 110 extends from the dealing discharge drive roller 106 to the larger dealing drive belt drive drum 112. A broad, continuous dealing friction belt 114 is mounted around the drive drum 112 and a dealing drive belt idler drum 116. The drive and idler drums 112, 116, respectively, are carried by drive belt carriage 118, including an adjustable, uppermost dealing anvil 120 whereby the uppermost surface of the belt 114 is generally coplanar with, but slightly above, the upper surface of the card pathway 94. The belt 114 extends in-line with the length of the pathway 94, and is generally centered therein.

The dealing module 14 includes a card picker and speed-up mechanism 121 adjacent the end of the belt 114 closest to the hand holding shoe 88. The speed-up mechanism 121 is mounted substantially in and under the hood 96, but could be mounted on the side guides 98, 100 as well. The speed-up mechanism 121 comprises a pivot shaft 122 on which a rigid discharge link 124 is movably mounted. A discharge idler roller 126 is mounted adjacent to the free end of the discharge link 124. A torsion spring 128 is provided to bias the idler roller 126 downwardly toward the dealing discharge drive roller 106. A brake link 130 is also pivotally mounted on the pivot shaft 122, but extends in a direction substantially opposite to the discharge link 124. A brake idler roller 132 is rotatably mounted at the free end of the brake link 130, and another torsion spring 133 is provided to bias the roller 132 downwardly.

Figure 4:
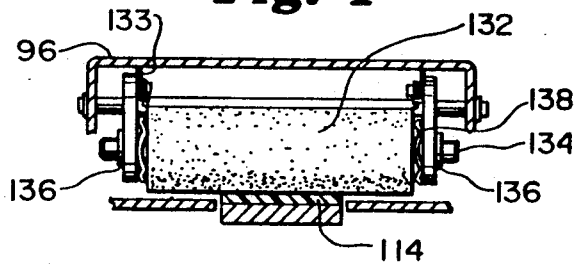
FIG. 4 is a fragmentary enlarged sectional view taken along line 4—4 in FIG. 3.

FIG. 4 shows additional details of the brake roller 132. The roller is rotatably supported on the brake link 130 by an axle 134 held in place by a snap retainer ring 136 on each side. A wrinkle or wave washer 138 is mounted between each end of the roller 132 and the inside of the link 130 to create an axial force inhibiting the free spinning or rotation of the brake roller 132. Although the brake roller 132 is depicted as cylindrical and rotatable, a non-rotatable rectangular deck brake or holding block could be substituted. Referring back to FIGS. 1 and 3, a deck weight 140 is pivotally mounted by weight pivots 142 to each side guide 98, 100 in line with and above the card pathway 94 generally between the speed-up mechanism 121 and the shuffling area 36.

The dealing module 14 includes a plurality of photo or optical microsensors including a deck passing sensor 144 in the card pathway 94 beneath the deck weight 140. A second sensor, the card counting sensor, 146 is located adjacent to the dealing discharge drive roller 106 in the card pathway 94 between the single card speed-up mechanism 121 and the hand holding shoe 88. A third optical sensor 148 is located in the hand holding shoe 88.

Figure 6:
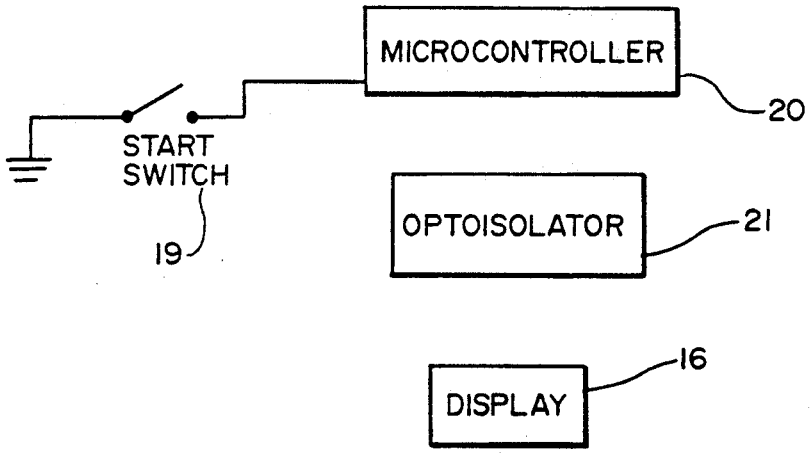
FIG. 6 is a block diagram of the components of the present invention that randomly select the symbol designating the first player to receive a hand.

Referring to FIG. 2A, the machine 10 of the present invention includes the display module 16, including a player readable display screen 150, an upright standard 152 and typical electrical connecting means 153 which links the display module 16 to the machine 10, specifically to the microprocessor controller 20. The upright standard 152 may be mounted directly on the housing 18 of the card shuffling module 12, to the surface 156 of a gaming table or support surface on which the machine 10 is resting, or it could be supported in any appropriate manner adjacent the area where a game is being played as long as the players of the game can view the display. The actual numerical or symbol LED display 158 may be provided by a lighted display system typified by the display means known as "digi-lites", (the LDS-AD series) manufactured by LUMEX, Inc., of Palatine, Ill. FIG. 6 depicts the components of the microprocessor 20 that randomly select the player designating number that will be displayed by the display 158. When the machine 10 is switched on an internal timer in the microprocessor 20 is started. The amount in the timer is progressively increased, i.e., changed 1,000 times per second, in effect providing a rotating random number register for randomly selecting a number from the numbers 1 through 7. After a set period of time, relating to the start of the retraction of the pusher head 66 after it delivers a shuffled deck to the dealing module 14, the microprocessor 20 retrieves the current number in the register and communicates it to the LED display 158. The electrical circuitry coupling the display module 16 to the controller 20, and thus to the shuffling module 12 and dealing module 14, may be of the type that is well known in the art.

In use, the shuffling module 12 of the machine 10 of the present invention may be operated as outlined hereinabove in the "Summary of the Invention". After the deck of cards is shuffled, the shuffled deck "D" (shown in FIG. 3) is held in the first deck receiving nest region 38. When the deck delivery sensor 144 indicates to the machine 10, through the microprocessor 20, that the portion of the card pathway 94 under the deck weight 140 is empty, the shuffled deck delivery system 60 is activated. The packing gate 48 is dropped and the pusher blade 62 is driven by the cog wheel 76 to move the transfer pusher head 66 in the direction of the hand holding shoe 88, thereby moving the shuffled deck "D" into the card pathway 94. The pusher head 66 is then retracted and the retraction initiates the random selection of the numbers (from 1 through 7) designating the first player to receive a hand. A delay period, substantially equal to the time it takes for the dealing module 14 to deal the first hand, is started and may include a "wheel-of-fortune" display on the display means 16.

As the shuffled deck "D" enters the dealing module 14, the bottom most card of the deck "D" contacts the dealing belt 114, and the entire deck is carried underneath the deck weight 140 until the deck "D" contacts the brake roller 132 as depicted in FIG. 3. As the belt 114 moves in the direction of the hand holding shoe 88, the bottom most card "C" of the deck "D" is drawn by the belt 114 toward and beneath the brake roller 132. Sufficient bias is generated by the torsion spring 133 biasing the brake roller 132 downwardly toward the belt 144 to allow only the bottom most card "C" to be moved toward and into the pinch area 160 formed between the discharge roller 126 and the discharge drive roller 106. As a card "C" enters into the pinch area 160, it is accelerated and pulled through to be deposited in the hand holding shoe 88. The card counting sensor 146 counts the gap or space between each subsequent card as the cards pass one at a time through and past the pinch area 160. Approximately when the passage of the fourth card is sensed by the sensor 146, the controller 20 operates the display portions of the program as outlined above, including a one-fourth second delay period during which a "wheel-of-fortune" display which starts fast and slows down can be provided, retrieves the current number in the rotating random number register, and causes the LED display 158 to display the selected random number.

In the meantime, the dealing module 14 has continued to move single cards into the hand holding shoe 88. As the last card of the first hand enters the shoe 88 (the seventh card if pai gow poker is being played) the symbol or number selected randomly by the microprocessor 20 to designate the first player to receive a hand number is displayed by the display module 16. If a side bet was made on which symbol would be selected, it may be resolved at this time or the dealer may immediately remove the first hand from the hand holding shoe 88 for distribution to the designated player. The removal of the hand from the shoe 88 causes the third sensor 148 to note the absence of a cards and triggers the dealing module 16, specifically the motor 102, reactivating the belt 114, to pull the bottom most card "C" into the pinch area 160 and move it into the hand holding shoe 88. Again, the gap between the cards or the cards themselves are counted to ensure that the desired number of cards is deposited in a hand in the hand holding shoe 88. This cycle is repeated until the cards of the shuffled deck are exhausted. The deck weight 140 is provided so that even when only a few cards remain to be moved into a hand, there will be adequate friction between the belt 114 and the bottom most card "C", thereby ensuring that a hand of the desired number of cards is formed in the hand holding shoe 88. When the shuffled deck "D" is exhausted, the first sensor 144 signals the microprocessor 20 to activate the delivery system 60 to push another shuffled deck, shuffled by the machine 10 while the previous deal and hand were taking place, into the dealing module 14.

Suitable specific components, and materials, for the shuffling machine 10 of the present invention may be selected from commercially available components including the following:

| Component | Specification |
|---|---|
| Microcontroller-20 | Part No. 80C32, Intel Corporation, Santa Clara, CA. |
| All motors | VEXTA TM low speed, snychronous motors or direct drive AC gear head motors, Oriental Motor Co., Tokyo, Japan. |
| Optoisolators | Optoisolators-Part No. MOC 3042 Motorola Semiconductor Products, Inc. Phoenix, AZ |
| Photosensors | Sensors 144, 148-Model EE-SPY401 by OMRON, Schaumburg, IL. Sensor 146-Model OPB981T51, by Optec, Carrollton, TX. |

It should be understood that the microcontroller 20 of the machine 10 of the present invention is programmed with a representative, standard set of program choices, and that other functions, choices, limits and parameters could be programmed easily to change or modify the outlined operational flow of the machine 10. For example, the number of times a deck of cards is shuffled may be changed, as can the number of cards the dealing module 14 deals to each hand. Thus, the machine 10 can be adapted to facilitate the play of any wagering game.

The present invention may be embodied in other specific forms without departing from the essential spirit or attributes thereof. It is therefore desired that the described embodiments be considered as illustrative, not restrictive, reference being made to the appended claims to indicate the scope of the invention.

What is claimed is:

1. An apparatus for facilitating playing a card game having generally accepted procedures, said apparatus comprising:

dealing means for sequentially dealing hands comprising a predetermined number of cards depending on said generally accepted procedures;

card shuffling means for shuffling cards including means for delivering shuffled cards to said dealing means; and display means for displaying a symbol related to said procedures.

2. The apparatus according to claim 1, wherein said dealing means comprises:

means for sequentially removing a bottom-most card from the shuffled cards and moving said bottom-most card to a hand-holding shoe;

means for counting said predetermined number of cards into each hand; and means for signalling the presence and absence of a hand in said shoe.

3. The apparatus according to claim 2, wherein said display means comprises an electronic player readable display board operatively connected to said dealing means.

4. The apparatus according to claim 3, wherein said card shuffling means comprises:

a carriage means for receiving a deck of cards, separating the deck into deck portions, moving the deck portions generally away from each other, relatively rotating the deck portions to and from an angular relationship, in which relationship a corner of one of said deck portions is adjacent to a corner of another of said deck portions, and urging the deck portions generally toward each other; and mandrel means for riffling said adjacent corners while said deck portions are being urged toward each other thereby interleaving the cards.

5. The apparatus according to claim 4, wherein said game is pai gow poker, and wherein said display board displays a randomly selected symbol related to said generally accepted procedures.

6. The apparatus according to claim 5, wherein said symbol is a numeral randomly selected from the numerals one through seven.

7. An automatic card shuffling machine for shuffling a deck of playing cards for use in playing a wagering game, said machine comprising:

dealing means for dealing a predetermined number of cards, one card at a time, into a hand holding shoe;

display means for displaying game information; and shuffling means for shuffling said deck of cards, said shuffling means for initially receiving and shuffling said deck of cards and including a shuffled deck delivery means for delivering a shuffled deck to said dealing means.

8. The machine according to claim 7, wherein said dealing means comprises:

means for receiving and holding said shuffled deck;

means for moving a bottom-most card from said shuffled deck and for moving each subsequent bottom-most card from said shuffled deck, and for moving each said bottom-most card to said hand holding shoe;

means for counting each said bottom-most card as said bottom-most card is moved to said hand holding shoe whereby said predetermined number of cards is moved to said hand holding shoe; and means for determining the presence and absence of a hand in said in said hand holding shoe.

9. The machine according to claim 8, wherein said means for determining the presence and absence of a hand comprises a microsensor for sensing the presence and absence of a hand, and for signalling the actuation of said means for moving said bottom-most card.

10. The machine according to claim 9, wherein said dealing means includes a deck delivery sensor means for sending a signal actuating said shuffled deck delivery means.

11. The machine according to claim 10, wherein said wagering game is pai gow poker.

* * * * *